US005404119A

United States Patent [19]

Kim

[11] Patent Number: 5,404,119

[45] Date of Patent: Apr. 4, 1995

[54] BANDPASS FILER HAVING PARALLEL-COUPLED LINES

[75] Inventor: Jae-won Kim, Seoul, Rep. of Korea

[73] Assignee: Samsung Electronics Co., Ltd., Kyungki, Rep. of Korea

[21] Appl. No.: 66,260

[22] Filed: May 25, 1993

[30] Foreign Application Priority Data

May 29, 1992 [KR] Rep. of Korea ..... 92-9332

[51] Int. Cl.[6] ..... H01P 1/203

[52] U.S. Cl. ..... 333/204; 333/246

[58] Field of Search ..... 333/203-205, 333/219, 238, 246

[56] References Cited

U.S. PATENT DOCUMENTS 4,851,797 7/1989 Nakamura ..... 333/204 X
5,187,459 2/1993 Russell et al. ..... 333/204

FOREIGN PATENT DOCUMENTS 0246102 12/1985 Japan ..... 333/204
0444286 6/1975 U.S.S.R. ..... 333/205
0559313 9/1977 U.S.S.R. ..... 333/204

OTHER PUBLICATIONS

Cohn, "Parallel-Coupled Transmission-Line-Resonator Filters", IRE Trans. on Microwave Theory & Tech. pp. 223-231, 1958.

Bahl, "Broadbanding Microstrop Filters Using Capacitive Compensation", Applied Microwave, pp. 70-76, Aug./Sep. 1989.

"Strip-Line Resonator Filters Having Multi-Coupled Sections", by Mitsuo Makimoto et al, IEEE MTT-S Digest, pp. 92-94, 1983.

*Primary Examiner*—Robert J. Pascal

*Attorney, Agent, or Firm*—Lowe, Price, Leblanc & Becker

[57] ABSTRACT

A bandpass filter having parallel-coupled lines is disclosed having at least one pair of two-terminal parallel-coupled lines disposed consecutively in a step form, wherein the widths of the pairs of two-terminal parallel couple lines are alternately increased and decreased.

3 Claims, 6 Drawing Sheets

BANDPASS FILER HAVING PARALLEL-COUPLED LINES

BACKGROUND OF THE INVENTION

The present invention pertains to a bandpass filter for use in the super-high-frequency (SHF) band, and particularly to a bandpass filter having parallel-coupled lines which uses microstrip lines as a resonator.

Generally, a bandpass filter for use in the SHF band is employed for the output port of an SHF transmitter, the input port of an SHF receiver and the output port of a frequency converter, so as to reduce the insertion loss of a transmitted signal and to enhance the capability of removing unwanted frequencies. Such a bandpass filter is utilized in an amplifier and frequency converter required for the configuration of ground microwave systems and satellite communication systems. SHF bandpass filters have been recently constructed such that an array of microstrip lines are formed in parallel. However, in the bandpass filter having parallel-coupled lines and using microstrip lines, the distance between parallel-coupled lines of the first and last parallel microstrip lines is below a specific value (0.1 mm), which makes the manufacturing of the filter difficult. Therefore, during filter design, the precise estimation of the insertion loss and bandwidth of such a bandpass filter is difficult.

Such problems will be described below in detail with reference to the attached drawings.

FIG. 1 is a schematic view of a general four-terminal parallel-coupled transmission line.

Referring to FIG. 1, the parallel-coupled transmission line comprises terminals 1 and 4 which constitute an input port, terminals 2 and 3 which constitute an output port, and microstrip lines 5 and 6 disposed in parallel while being spaced apart by a distance d and each characterized by having a length l and a width W. Here, length l has a value corresponding to one fourth the wavelength ($\lambda/4$) of a signal.

FIG. 2 is a schematic view of a conventional bandpass filter having parallel-coupled lines and using a stepped impedance resonator. Referring to FIG. 2, two-terminal parallel-coupled lines $BL_1 \sim BL_{n+1}$ (wherein terminals 3 and 4 of the four-terminal parallel-coupled line of FIG. 1 are left open) are consecutively arranged in a step form. The two-terminal parallel-coupled lines $BL_1 \sim BL_{n+1}$ are formed with microstrip lines $SL_1 \sim SL_{2n+2}$ which are disposed so as to have different distances $d_1 \sim d_{n+1}$. Impedance $Z_0$ indicates the characteristic impedance of the input line and output line.

FIG. 3A is an equivalent circuit diagram of an arbitrary (i+1)th two-terminal parallel-coupled line $BL_{i+1}$ of the bandpass filter having parallel-coupled lines shown in FIG. 2. Referring to FIG. 3A, for admittance inverter $j_{(i,i+1)}$, the characteristic impedance thereof equals that of the input/output lines of the bandpass filter. Also, input/output lines $\phi L_{2i}$ and $\phi L_{2i+1}$ are each one quarter wave in length.

FIG. 3B is an equivalent circuit diagram of the bandpass filter having parallel-coupled lines shown in FIG. 2. Referring to FIG. 3B, n+1 admittance inverters $j_{(0,1)} \sim j_{(n,n+1)}$ are connected in series via input/output lines $\phi L_0 \sim \phi L_{2n+1}$ each of which are also one quarter wave in length. The characteristic impedance of the quarter-wavelength input/output lines $\phi L_0 \sim \phi L_{2n+1}$ is equal to input/output impedance $Z_0$ of the bandpass filter. Therefore, the impedances $Z(e)_0$ (even mode) and $Z(o)_0$ (odd mode) of each of the two-terminal parallel-coupled lines $BL_1 \sim BL_{n+1}$ shown in FIG. 2 are expressed as follows:

$$Z(e)_{0(i,i+1)} = Z_0[1 + Z_0 \cdot j_{(i,i+1)} \{Z_0 \cdot j_{(i,i+1)}\}^2] \quad (1)$$

$$Z(o)_{0(i,i+1)} = Z_0[1 + Z_0 \cdot j_{(i,i+1)} - \{Z_0 \cdot j_{(i,i+1)}\}^2] \quad (2)$$

Using Equations (1) and (2), if the impedances of the even mode and odd mode of the first and last parallel-coupled lines $BL_1$ and $BL_{n+1}$ of the bandpass filter shown in FIG. 2 are calculated, it is noted that the impedances $Z(e)_{0(0,1)}$ and $Z(o)_{0(0,1)}$ of the first parallel-coupled line is the same as the impedances $Z(e)_{0(n,n+1)}$ and $Z(O)_{0(n,n+1)}$ of the last parallel-coupled line. Using the impedance values of the even mode and odd mode, if the width W of microstrip lines $SL_1$, $SL_2$, $SL_{2n+1}$ and $SL_{2n+2}$ constituting the first and last parallel-coupled lines $BL_1$ and $BL_{n+1}$ and distance d between the microstrip lines are calculated, the value of distance d is less than 0.1 mm. This is not easy to accomplish with ordinary print circuit boards (for instance, epoxy-glass boards).

To overcome the above problem (when $d < 0.1$ mm), Mitsuo Makimoto and Sadahiko Yamashita (both of Japan) have disclosed in a paper entitled "Strip-line Resonator Filters having Multi-coupled Sections (IEEE MTT-S DIGEST, pp. 92–94, 1983), that the first and last terminal pairs $BL_1$ and $BL_{n+1}$ of the bandpass filter shown in FIG. 2 are multi-coupled, as shown in FIG. 4. However, in a filter having such a structure, the microstrip lines are discontinuous in the multi-coupled portions 30 and 31, which causes errors in circuit interpretation and thus impedes the precise estimation of insertion loss and bandwidth of a specific bandpass filter during design.

SUMMARY OF THE INVENTION

Therefore, it is an object of the present invention to provide a bandpass filter having parallel-coupled lines and using a stepped impedance resonator which increases the distance between microstrip lines for the first and last parallel-coupled microstrip lines of the filter, and which has no discontinuous sections in the microstrip lines.

To accomplish the object of the present invention, there is provided a bandpass filter having parallel-coupled lines, comprising at least one pair of two-terminal parallel-coupled lines disposed consecutively in a step form, wherein the width of the at least pair of two-terminal parallel couple lines is alternately increased and decreased.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1:
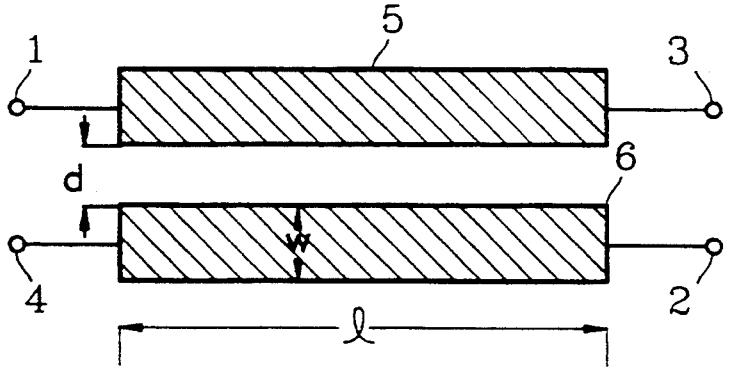
FIG. 1 is a schematic view of a four-terminal parallel-coupled transmission line.
Figure 2:
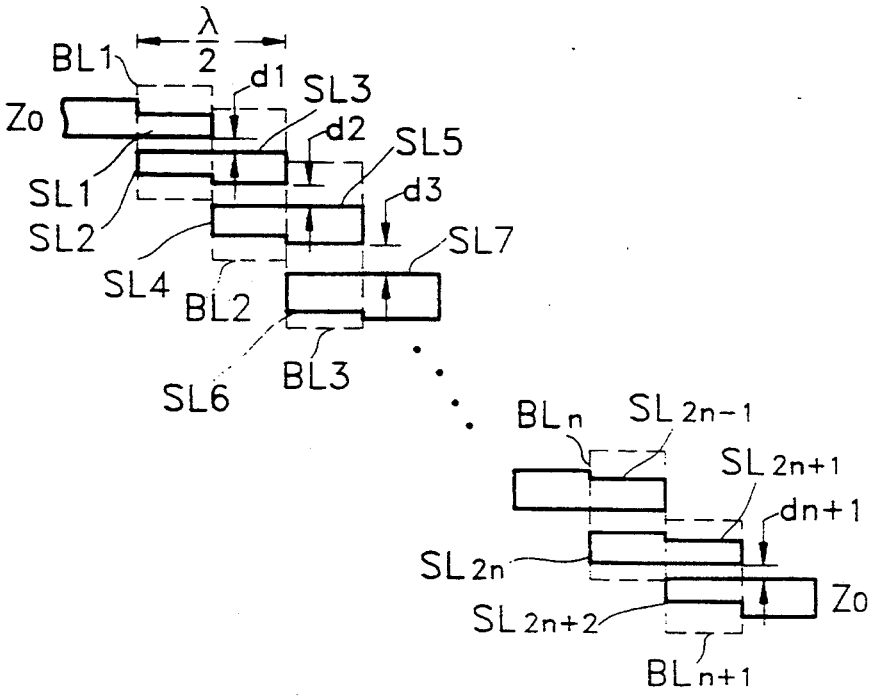
FIG. 2 (PRIOR ART)
FIG. 2 is a schematic view of a conventional bandpass filter having parallel-coupled lines.
Figure 3A:
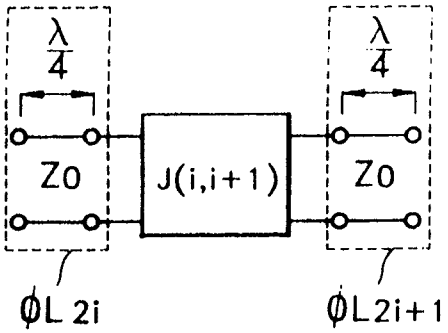
FIG. 3A (PRIOR ART)
FIG. 3A is an equivalent circuit diagram of an (i+1)th two-ports parallel-coupled line of the bandpass filter shown in FIG. 2.
Figure 3B:
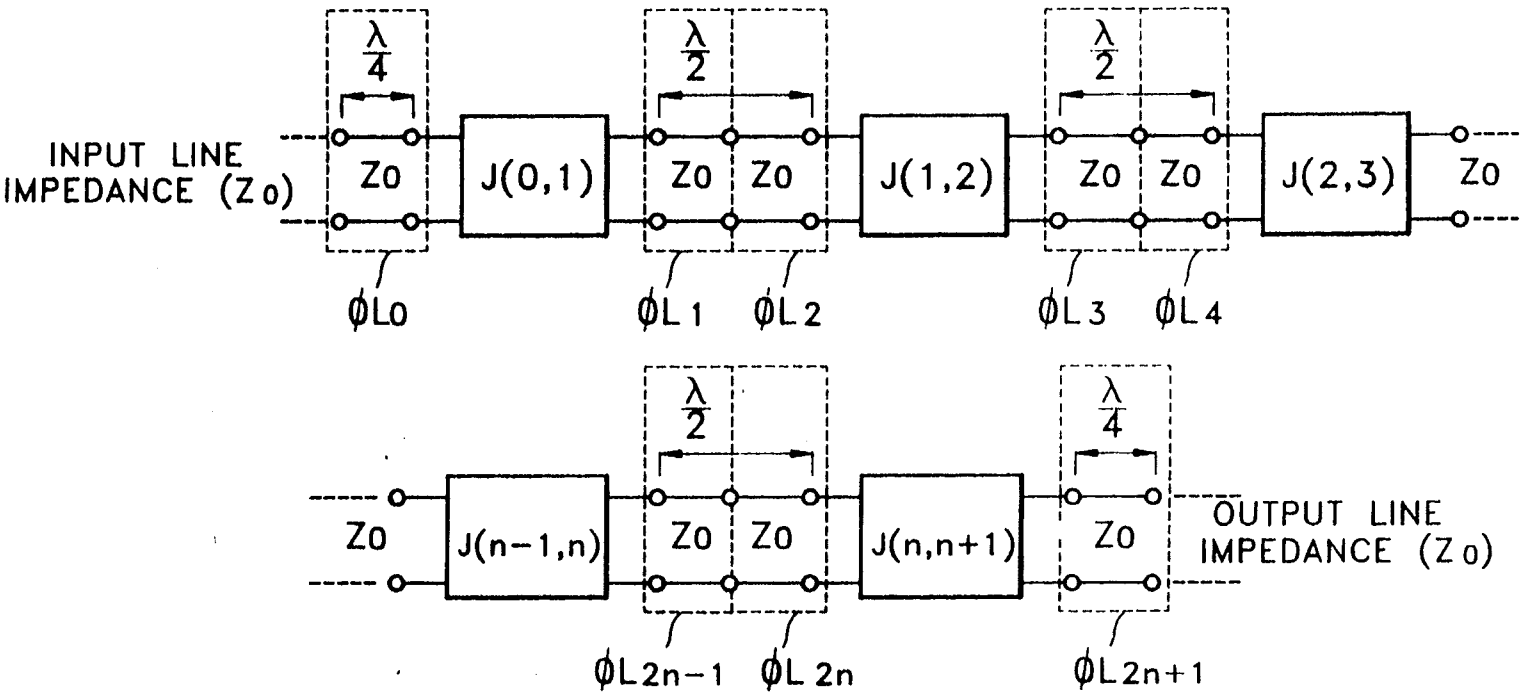
FIG. 3B (PRIOR ART)
FIG. 3B is an equivalent circuit diagram of the bandpass filter shown in FIG. 2.
Figure 4:
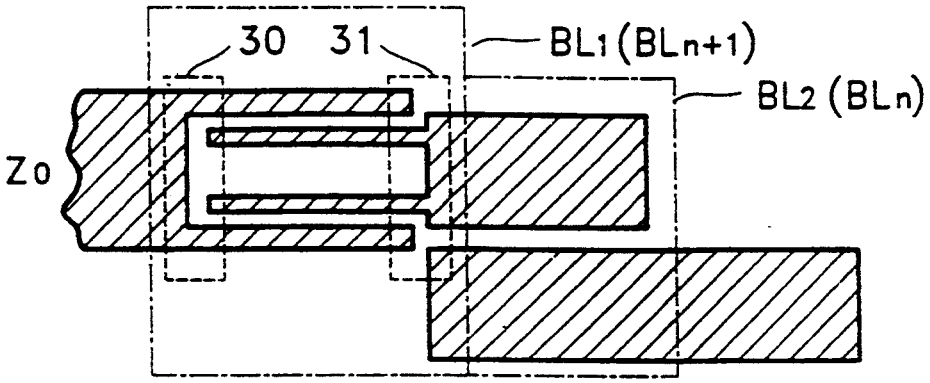
FIG. 4 (PRIOR ART)
FIG. 4 shows a multi-coupled structure of the first and last terminal pairs of the parallel-coupled lines of the bandpass filter shown in FIG. 2.
Figure 5:
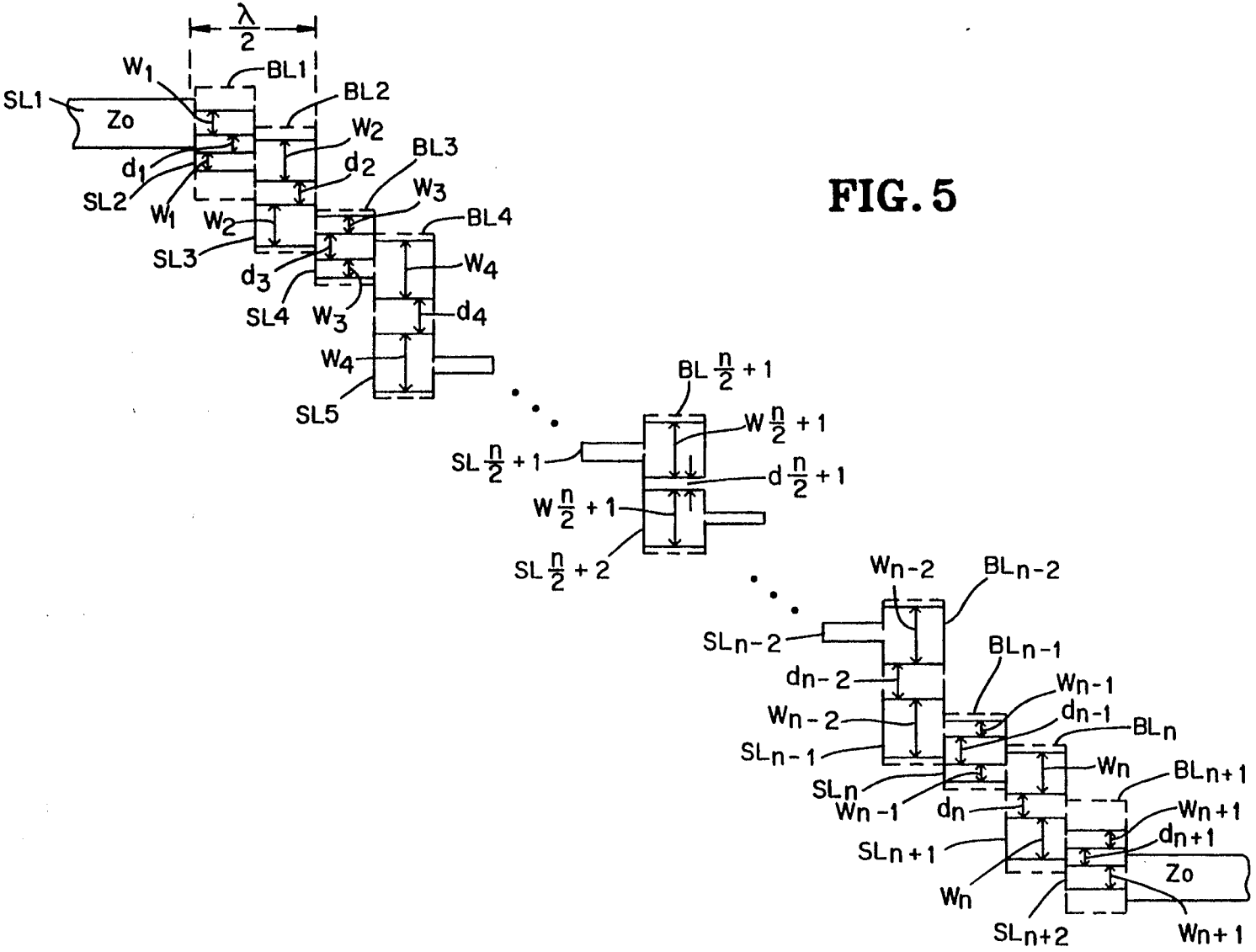
FIG. 5 is a schematic view of a bandpass filter of the present invention.

Referring to FIG. 5, n+1 two-terminal parallel-coupled lines $BL_1 \sim BL_{n+1}$ are consecutively arrayed in a step form. To form n+1 parallel-coupled lines $BL_1 \sim BL_{n+1}$, microstrip lines $SL_1 \sim SL_{n+2}$ each disposed in parallel and spaced apart by a predetermined distance $d_1 \sim d_{n+1}$ (same as di+1) have widths $W_{i+1}$ (where i is an even number including zero) which are much wider or much narrower than those of adjacent pairs of the microstrip lines of parallel-coupled lines $BL_1 \sim BL_{n+1}$, and have lengths corresponding to one fourth the wavelength ($\lambda/4$) of the signal to be processed. Each microstrip line consists of a first portion having a first width and a second portion having a second width, with the first portion being the narrower width and the second portion being wider. The first parallel-coupled line $BL_1$ is composed of the first portion of microstrip line $SL_1$ of width $W_1$ and the first portion of microstrip line $SL_2$ of width $W_1$, and the distance between the microstrip lines is $d_1$. The second parallel-coupled line $BL_2$ is composed of the second portion of microstrip line $SL_2$ of width $W_2$ and the second portion of microstrip line $SL_3$ of width $W_2$, and the distance between the microstrip lines is $d_2$. The central parallel-coupled line $BL_{n/2+1}$ is composed of the second portion of microstrip line $SL_{n/2+1}$ of width $W_{n/2+1}$ and the second portion of microstrip line $SL_{n/2+2}$ of width $W_{n/2+1}$, and the distance between the microstrip lines is $d_{n/2+1}$. The parallel-coupled lines are symmetric with respect to the central parallel-coupled line $BL_{n/2+1}$ so that width $W_1$ and distance $d_1$ of the first parallel-coupled line $BL_1$ is the same as those of the (n+1)th parallel-coupled line $BL_{n+1}$. Similarly, width $W_2$ and distance $d_2$ of the second parallel-coupled line $BL_2$ is the same as those of the nth parallel-coupled line $BL_n$. Microstrip line $SL_1$ functions as the input port of the bandpass filter and microstrip line $SL_{n+2}$ acts as the output port thereof.

Figure 6:
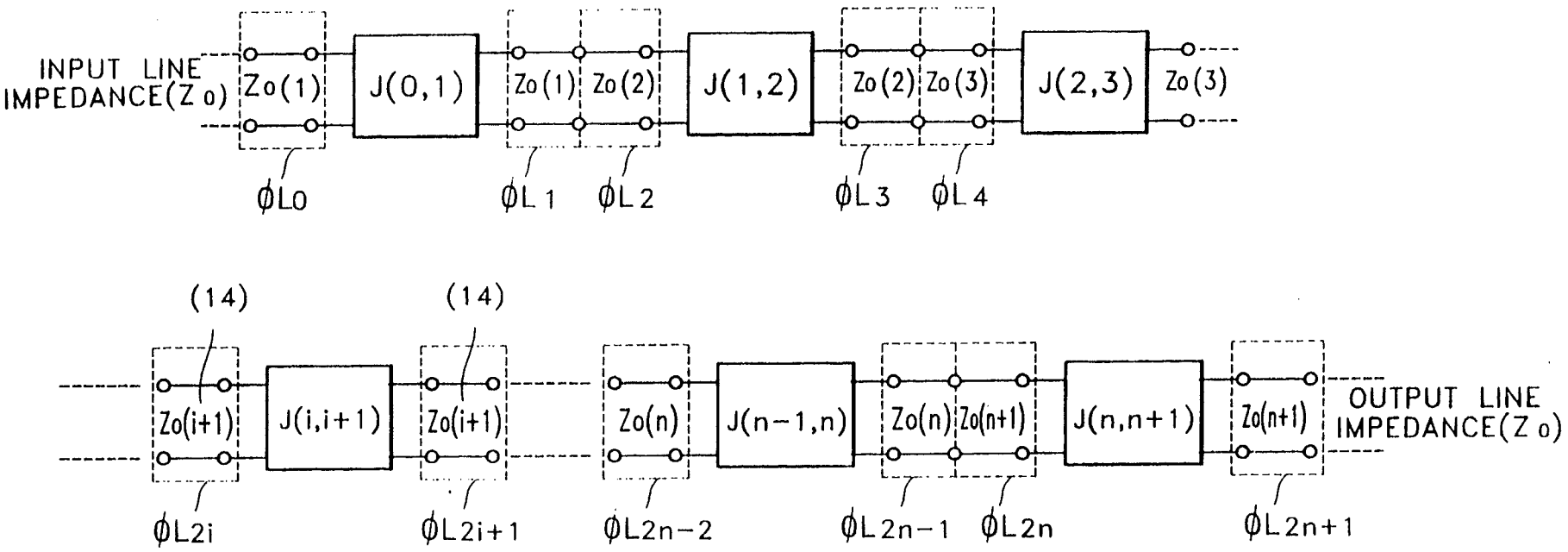
FIG. 6 is an equivalent circuit diagram of the bandpass filter having parallel-coupled lines shown in FIG. 5.

Referring to FIG. 6, n+1 admittance inverters $j_{(0,1)} \sim j_{(n,n+1)}$ have quarter-wavelength input/output lines $\phi L_0 \sim \phi L_{2n+1}$ on the input and output port sides. The characteristic impedance of quarter-wavelength input/output lines $\phi L_0 \sim \phi L_{2n+1}$ of each of the admittance inverters $j_{(0.1)} \sim j_{(n,n+1)}$ is set as $Z_{0(i+1)}$ which is a different value from the characteristic impedances of the quarter-wavelength lines of the adjacent admittance inverters.

According to the characteristic impedance $Z_{0(i+1)}$ of the quarter-wavelength input/output lines $\phi L_1 \sim \phi L_{2n+1}$ shown in FIG. 6, the impedances $Z(e)_0$ (even mode) and $Z(o)_0$ (odd mode) of the two-terminal parallel-coupled lines $BL_1 \sim BL_{n+1}$ shown in FIG. 5 will be expressed as follows:

$$Z(e)_{0(i,i+1)} = Z_{0(i+1)}[1 + Z_{0(i+1)} \cdot Z_{(i,i+1)} + \{Z_{0(i+1)} \cdot j_{(i,i+1)}\}^2] \quad (3)$$

$$Z(o)_{0(i,i+1)} = Z_{0(i+1)}[1 - Z_{0(i+1)} \cdot j_{(i,j+1)} + \{Z_{0(i+1)} \cdot j_{(i,i+1)}\}^2] \quad (4)$$

Using Equations (3) and (4), if the impedances of the even mode and odd mode of the first and last parallel-coupled lines $BL_1$ and $BL_{n+1}$ in the bandpass filter shown in FIG. 5 are calculated, it is noted that the impedances $Z(e)_{0(0,1)}$ and $Z(o)_{0(0,1)}$ of the first parallel-coupled line $BL_1$ is not the same as the impedances $Z(e)_{0(n,n+1)}$ and $Z(o)_{0(n,n+1)}$ of the last parallel-coupled line $BL_{n+1}$. However, for circuit symmetry, when the characteristic impedance $Z_{o(i)}$ of quarter-wavelength input/output lines $\phi L_{2i-1}$ and $\phi L_{2i}$ of the ith parallel-coupled line $BL_i$ (if it is n/2+1, located in the center of the two-terminal parallel-coupled lines $BL_1 \sim BL_{n+1}$ constituting the bandpass filter of FIG. 5) is set to be the same as the characteristic impedances of adjacent parallel-coupled lines $BL_{i-1}$ and $BL_{i+1}$, the impedances $Z(e)_{0(0,1)}$ and $Z(o)_{0(0,1)}$ of tile first two-terminal parallel-coupled line $BL_1$ are tile same as the impedances $Z(e)_{0(n,n+1)}$ and $Z(o)_{0(n,n+1)}$ of (n+1)th parallel-coupled line $BL_{n+1}$. Using the actually obtained impedances $Z(e)_{0(0,1)} \sim Z(e)_{0(n,n+1)}$ and $Z(o)_{0(0,1)} \sim Z(o)_{0(n,n+1)}$ of two-terminal parallel-coupled lines $BL_1 \sim BL_{n+1}$, if the width and distance of microstrip lines $SL_1 \sim SL_{n+2}$ of two-terminal parallel-coupled lines $BL_1 \sim BL_{n+1}$ are calculated, the values of distances $d_1 \sim d_{n+1}$ between the microstrip lines are all above 0.15 mm, which is easy to accomplish using ordinary print circuit boards. This is because the width and distance of parallel-coupled lines are determined by the impedances of the even mode and odd mode, and the greater the difference thereof is, the wider the distance between parallel-coupled lines becomes. Therefore, in the present invention, the characteristic impedance $Z_{0(i+1)}$ of line 14 shown in FIG. 6 is set to be greater than $Z_0$. If the bandpass filter having parallel-coupled lines of FIG. 5 has seven two-terminal parallel-coupled lines when the value of n is six, the widths $W_i$ of microstrip lines $SL_1 \sim SL_8$ constituting seven two-terminal parallel-coupled lines $BL_1 \sim BL_7$ and distances $d_i$ between the microstrip lines are given in the following Table 1.

<TABLE 1>

| parallel-coupled line number | microstrip line width ($w_i$) | distance between microstrip lines ($d_i$) |
|---|---|---|
| $BL_1$ | 0.58235 mm | 0.1578 mm |
| $BL_2$ | 0.89204 mm | 0.4743 mm |
| $BL_3$ | 0.48427 mm | 1.0581 mm |
| $BL_4$ | 1.47594 mm | 0.5402 mm |
| $BL_5$ | 0.48427 mm | 1.0581 mm |
| $BL_6$ | 0.89204 mm | 0.4743 mm |
| $BL_7$ | 0.58235 mm | 0.1578 mm |

Reviewing the width ($W_i$) and distance ($d_i$) of the parallel-coupled lines of Table 1, it is noted that they are symmetric, centering on parallel-coupled line $BL_4$ and that as the parallel-coupled line numbers increase, the widths of the parallel-coupled lines alternately increase and decrease. Specifically, the width and distance of $BL_1$ are the same as those of $BL_7$, those of $BL_2$ match those of $BL_6$, and those of $BL_3$ match those of $BL_5$. Also, the width of $BL_2$ is increased more than that of $BL_1$, the width of $BL_3$ is decreased more than that of $BL_2$, and the width of $BL_4$ is increased more than that of $BL_3$.

Figure 7:
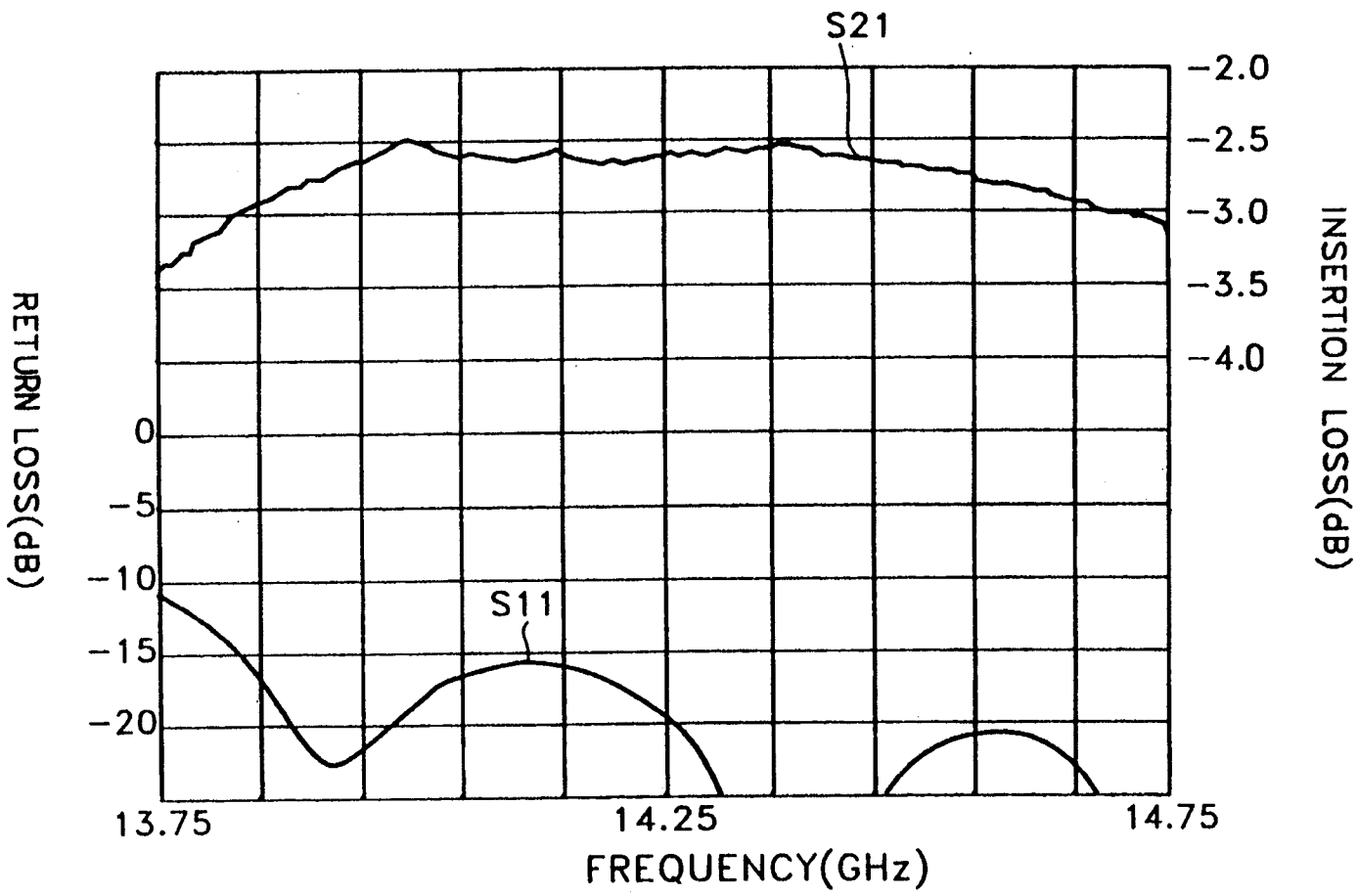
FIG. 7 is a characteristic graph of the insertion loss and return loss of the bandpass filter having parallel-coupled lines shown in FIG. 4.

FIG. 7 shows the insertion loss (S21) and return loss (S11) of the bandpass filter having parallel-coupled lines and manufactured according to the values of Table 1. In FIG. 7, the abscissa represents frequency (in gigahertz), and the ordinate represents response (in decibels). The insertion loss at center frequency (14.25GHz) is 2.61 dB, while the return loss is 19.13 dB.

As described above, in the present invention, the distance between parallel-coupled lines is over 0.15 mm so as to provide a bandpass filter having parallel-coupled lines and using a stepped impedance resonator which can be easily manufactured on ordinary print circuit boards. Further, in the present invention, the range of the distance between parallel-coupled lines becomes wider than the conventional one so that the insertion loss of the bandpass filter can be reduced and its bandwidth can be broadened.

What is claimed is:

1. A bandpass filter comprising:

an input port;

an output port; and a plurality of parallel-coupled lines formed between said input and output ports, each of said parallel-coupled lines being formed of segments of a microstrip line having a first portion with a first width and a second portion with a second width, and first portions of adjacent microstrip lines being coupled to form a parallel-coupled line and second portions of adjacent microstrip lines being coupled to form another parallel coupled-line, wherein said each second width is greater than said each first width such that widths of said microstrip lines forming said plurality of parallel-coupled lines alternately increase and decrease, and wherein said microstrip lines forming each parallel-coupled line are separated by a predetermined distance, and said predetermined distance of said microstrip lines forming each parallel-coupled line decreases from parallel-coupled lines located adjacent to a parallel-coupled line centrally located from said input and output ports.

2. The bandpass filter of claim 1, wherein decreases of said predetermined distance are symmetrical between the parallel-coupled lines disposed between said input port and the centrally located parallel-coupled lines and the parallel-coupled lines disposed between said output port and the centrally located parallel-coupled lines.

3. The bandpass filter of claim 1, wherein said predetermined distance is at least 0.1 mm.

* * * * *